United States Patent [19]

Justice et al.

[11] Patent Number: 4,889,392

[45] Date of Patent: Dec. 26, 1989

[54] ADVANCE/RETREAT CUTTING MINER AND METHOD

[75] Inventors: James C. Justice; Frank A. Delli-Gatti, Jr., both of Beckley, W. Va.

[73] Assignee: Coaltex, Inc., Beckley, W. Va.

[21] Appl. No.: 316,895

[22] Filed: Feb. 28, 1989

[51] Int. Cl.[4] ..... E21C 27/22; E21C 41/00

[52] U.S. Cl. ..... 299/18; 299/57; 299/80

[58] Field of Search ..... 299/10, 12, 18, 55, 299/56, 57, 59, 64, 67, 80; 175/91

[56] References Cited

U.S. PATENT DOCUMENTS

| | | | |
|---|---|---|---|
| 4,003,602 | 1/1977 | Justice et al. | 299/18 |
| 4,082,362 | 4/1978 | Justice et al. | 299/57 |
| 4,120,535 | 10/1978 | Delli-Gatti, Jr. | 299/18 |
| 4,556,257 | 12/1985 | Justice et al. | 299/68 |

FOREIGN PATENT DOCUMENTS

| | | | |
|---|---|---|---|
| 274047 | 9/1970 | U.S.S.R. | 299/56 |
| 394530 | 12/1973 | U.S.S.R. | 299/55 |
| 587250 | 1/1978 | U.S.S.R. | 299/57 |
| 794157 | 2/1981 | U.S.S.R. | 175/91 |

*Primary Examiner*—Jerome W. Massie, IV

*Assistant Examiner*—David J. Bagnell

*Attorney, Agent, or Firm*—Nixon & Vanderhye

[57] ABSTRACT

A mining machine and method allow coal or the like to be mined substantially as quickly during out cutting as in cutting. A front cutter is mounted at the front of the frame, and a first conveyor, which preferably comprises a chain conveyer, conveys cut coal from the front of the frame to the rear and ultimately out of the area being mined. A second conveyor is mounted in back of the front cutter for conveying cut coal from adjacent the rear of the frame towards the front, and ultimately to be deposited on the first conveyor. A rear cutter is located to the rear of the second conveyor for cutting material during out cutting to be moved to the second conveyor as the machine moves rearwardly. The rear cutter is movable from a first inoperative position within the volume cut by the front cutter, to a second, operative position outside the volume cut by the front cutter. The second conveyor may comprise shrouds pivotally mounted about their front ends, with spiral conveyors for conveying coal from the shrouds to the chain conveyor, or may comprise universal conveyor chains mounted in slides with inwardly curved front code. The rear cutters may comprise cutter drums mounted for rotation about either horizontal or vertical axes.

20 Claims, 6 Drawing Sheets

ADVANCE/RETREAT CUTTING MINER AND METHOD

BACKGROUND AND SUMMARY OF THE INVENTION

In the mining of coal, or like material which must be mined in high volume, it is very desirable to expose the operators to as few safety risks as possible. This is conventionally done by utilizing mining machines which bore into an area to be mined and continuously remove the cut coal from the mined area. In order to make such mining machines most economical, it is desirable to cut coal during retreat from the mined area, as well as during advance into the mined area. This has been successfully accomplished by mining machines such as shown in U.S. Pat. No. 4,082,362. However even though such machines are successful in cutting both during advance and retreat, cutting during retreat is much slower than desirable since the conveying action during out cutting is not as efficient as the conveying action during in cutting.

According to the present invention, a mining machine and method of mining coal or the like are provided which have efficient conveying mechanisms such that it is possible to effect out cutting substantially as fast as in cutting. This is accomplished by providing conveying means that act in such a manner that the mining machine is essentially "advancing" both during in cutting and out cutting.

According to one aspect of the present invention, a mining machine for out cutting substantially as quickly as it in cuts is provided.

The mining machine comprises a frame, a front cutting means mounted adjacent the front of the frame, and a first conveying means for conveying cut material from a front portion of the frame to the rear, and ultimately out of the area being mined. A second conveying means is mounted in back of the front cutting means, for conveying cut material from adjacent the rear of the frame toward the front, to be deposited on the first conveying means. A rear cutting means is located to the rear of the second conveying means for cutting material to be moved to the second conveying means as the machine is moving rearwardly (i.e. during out cutting).

According to a first preferred embodiment of the present invention, a mining machine is provided which comprises the following elements: A frame. A front cutting means mounted adjacent the front of the frame. A chain conveyor extending rearwardly from adjacent the front cutting means to convey cut material to the rear and ultimately out of the area being mined. Shroud means pivotally mounted adjacent the front end thereof mounted on the frame along the length of the first conveying means. Conveying means mounted adjacent the front end of the shroud means and above the chain conveying means for conveying cut material from the shroud means to the chain conveying means. And, rear cutting means mounted to the rear of the shroud means, and mounted for movement from a first, inoperative position within the volume defined by the front cutting means, to a second, operative position, outside the volume mined by the front cutting means.

According to a second preferred embodiment of the present invention, a mining machine is provided which comprises the following elements: A frame. A front cutting means mounted adjacent the front of the frame. A chain conveyor extending rearwardly from adjacent the front cutting means to convey cut material to the rear and ultimately out of the area being mined. A pair of universal conveyor chains, are mounted on either side of the conveying chain, and disposed within a channel having an inwardly arcuately shaped and positioned portion to deposit cut material onto the conveyor chain. And, rear cutting means located to the rear of the universal conveyor chain, and mounted for movement from a first, inoperative position within the volume defined by the front cutting means, to a second, operative position, outside the volume mined by the front cutting means.

According to the present invention there also is provided a method of mining material, such as coal. The method comprises the following steps: (a) Cutting into the area to be mined using a mining machine by moving the mining machine in a forward direction, to form a bore having given first dimensions. (b) Removing cut material as the mining machine is moved in the forward direction by moving the material rearwardly out of the area being mined. (c) Terminating forward movement into the area being mined, and then moving the mining machine rearwardly out of the bore while continuing to cut material so as to enlarge the bore from the first dimensions to second dimensions greater than the first dimensions. And, (d) conveying the material cut during rearward movement first in a forward direction, and then ultimately rearwardly so that it moves out of the area being mined in the same manner that the material cut during forward movement is moved out of the area being mined.

It is the primary object of the present invention to provide the rapid out cutting of coal or the like during mining with a mining machine. This and other objects of the invention will become clear from an inspection of the detailed description of the invention and from the appended claims.

DETAILED DESCRIPTION OF THE DRAWINGS

Figure 1A:
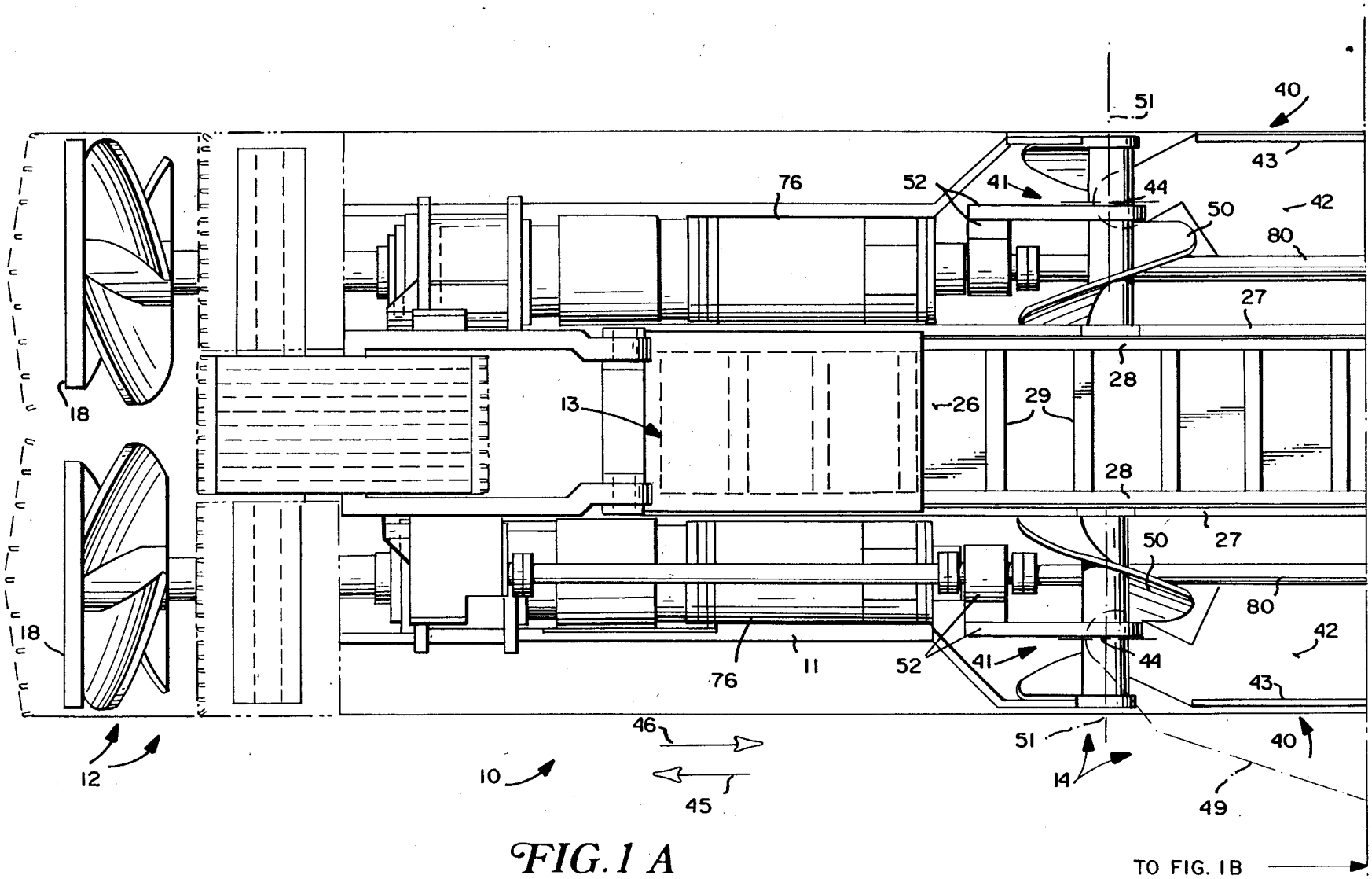
FIGS. 1A and 1B are a top plan view of a first embodiment of a mining machine according to the invention.
Figure 1B:
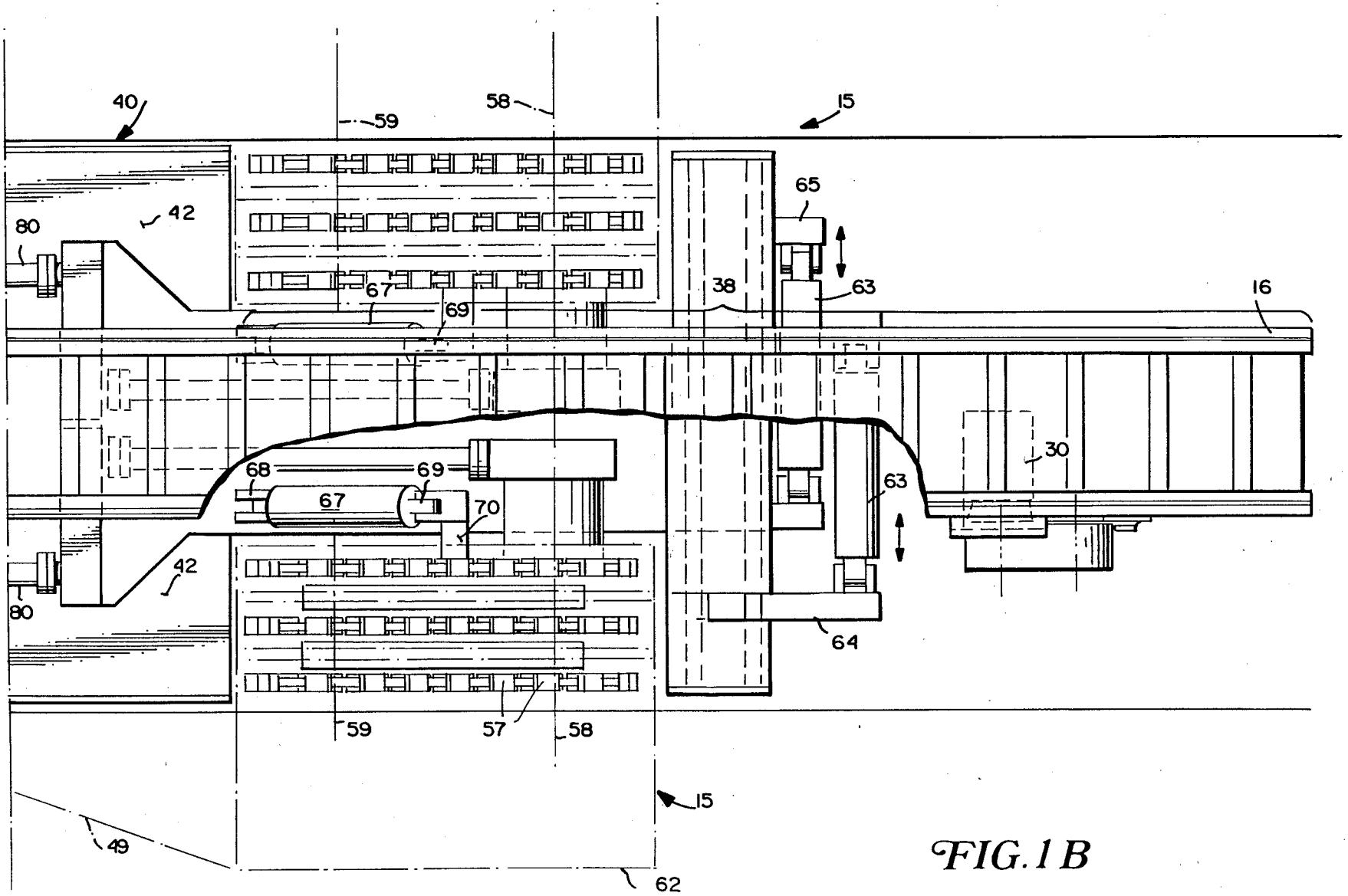
Figure 2A:
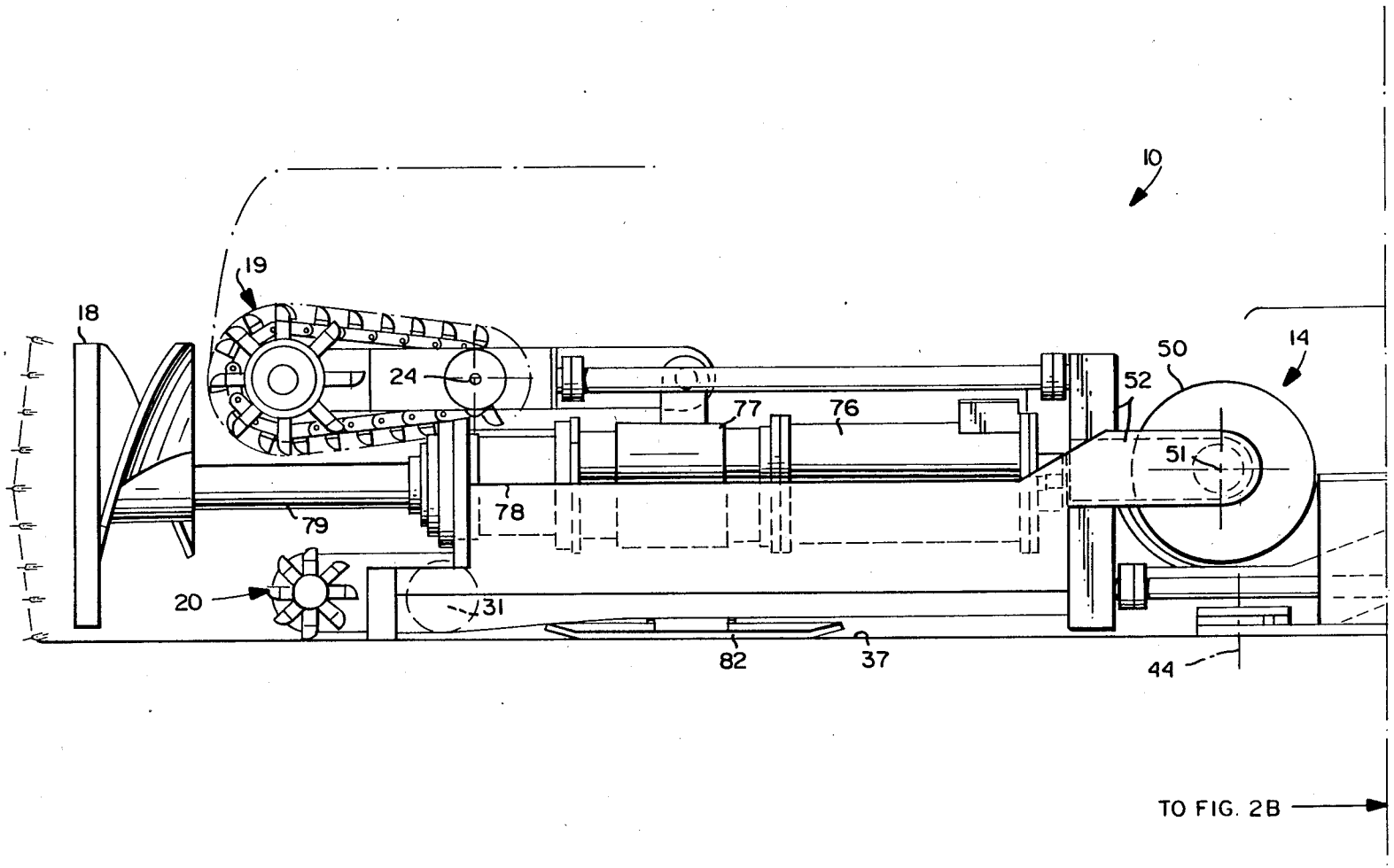
FIGS. 2A and 2B are a side view of the mining machine of FIG. 1.
Figure 2B:
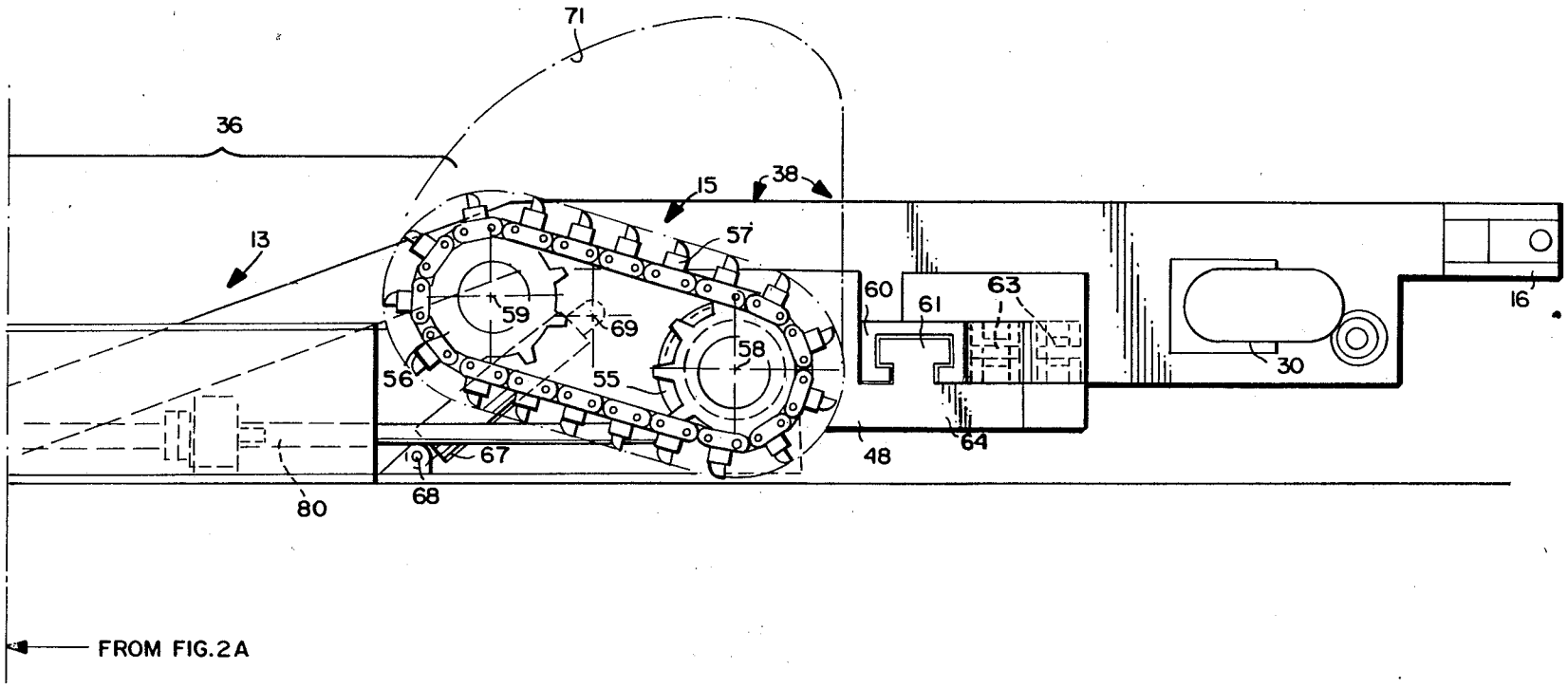

A first preferred embodiment of a mining machine according to the present invention is illustrated generally by reference numeral 10 in FIGS. 1 and 2. The mining machine comprises a main frame 11 to which all of the components are mounted. The major components include a front cutting means, shown generally by reference numeral 12, mounted adjacent the front end of the frame 11; a first conveying means, indicated generally by reference number 13; a second conveying means, indicated generally by reference numeral 14; and a rear cutting means, indicated generally by reference numeral 15. The entire structure 10 is adapted to be connected up, at the rearward most portion 16 of the frame thereof, to separate belt or chain conveyor modules to ultimately convey cut coal or like material from the area being mined to the mouth of the mine. The details of such separate conveyor modules are not part of the present invention, and may take a variety of conventional forms such as shown in U.S. Pat. Nos. 4,082,362 or 4,120,535.

The front cutting means 12 may take a wide variety of forms, but according to the preferred embodiment it is desirable to provide all of the cutters illustrated in FIGS. 1 and 2. These include front-most rotatable cutting heads 18, a conventional top cob cutter 19, and a conventional bottom cob cutter 20. The cob cutters extend no more than the width of the cutting heads 18 during in cutting, and even out and reshape the bore. The bore width is illustrated by reference numeral 21 in FIG. 4, and the area 22 above the rotatable front cutters 18 is cut by the top cob cutter 19, and the areas 23 at the bottom of the bore between and adjacent the rotatable cutters 18 is cut by the bottom cob cutter 20. The top cob cutter 19 may be pivoted upwardly about horizontal shaft 24 to a position above the rotatable cutters 18 to cut the area 22.

The first conveying means 13 comprises means for conveying cut coal from the front portion of the frame 11 toward the rear, and ultimately out of the area being mined (by the additional conveyors ultimately attached to the rear-most portion 16 of the frame 11). While the first conveying means may take a variety of forms, in the preferred embodiment illustrated in FIGS. 1 through 3 it comprises a chain conveyor having a plate 26 over which the coal is conveyed, sidewalls 27 (see FIG. 1A) for maintaining the coal within the area above the plate 26, a pair of chains 28 on opposite sides of the plate 26, and flights 29 extending between the chains. A drive motor 30 powers the chains 28 around sprockets, as is conventional. The tail shaft for the chin conveyor 13 is mounted just to the rear of the bottom cob cutter 20, as shown schematically by dotted line element 31 in FIG. 2A. As shown in more detail in FIG. 3, the chains 28 go around the tail shaft 31 in a return mode below the plate 26 and in a conveying mode above the plate 26. A bottom plate 33 also is provided, which is turned up as indicated by reference numeral 34 at the front portion thereof at the tail shaft 31, to initially assist in moving the coal up onto the plate 26. The basic elements of the chain conveyor 13 are readily commercially available.

In the area illustrated by reference numeral 36 in FIG. 2, the chain conveyor 13 is elevated, sloping upwardly from its initial position at or just above the bore floor 37 to elevated area 38 which is adapted to be connected up to the additional conveyors at the rearward-most portion 16 of the frame 11. The elevated area 38 may be seen both in FIGS. 1 and 2.

The mining machine 10 also comprises a second conveying means 14. The second conveying means 14 is mounted in back of the front cutting means 12 and conveys cut material from adjacent the rear of the frame 11 toward the front, to ultimately be deposited on the first conveying means 13. It is the operation of the second conveying means 14 in conjunction with the rear cutting means 15 which allows the rapid out cutting that is characteristic of the present invention.

In the preferred embodiment illustrated in FIGS. 1 and 2, the second conveying means comprises shroud means 40, and conveyor means 41 (preferably spiral conveyors). The shroud means comprise shovel-like structures having bottom plate portions 42 (see FIG. 1) and upright sidewalls 43. A shroud is mounted on each side of the main conveyor 13. The shrouds are pivotally mounted about a vertical axis at pivot points 44 adjacent the front portions thereof. During in cutting, the mining machine 10 moves in the direction of arrow 45 (FIG. IA, that is it advances, moves frontwardly) and during out cutting it moves in the direction of arrow 46 (that is it retreats, moves rearwardly). During the retreating movement of the machine 10 in the direction of arrow 46, the shrouds 40 essentially scoop up the mined coal from the bore floor 37 and during the natural movement of the machine 10 out of the bore move the coal up toward the conveyors 41. The shrouds 40 are connected by lost motion means, such as links (not shown) to the rear cutter frame 48 for movement to the operative, dotted line condition illustrated generally by reference numeral 49 in FIG. 1, to in a manner that will be explained hereafter.

The conveyors 41 preferably comprise spiral flights 50 that are rotatable about horizontal axes 51, and are driven by reach gears or like drive components illustrated schematically by reference numerals 52. The spiral flights 50 engage the coal scooped upwardly by the shrouds 40 and move the coal horizontally inwardly to a position above the first conveyor 13, depositing on the first conveyor 13 to be moved rearwardly out of the area being mined. Note as most clearly shown in FIG. 2 that the spiral flights 50 are mounted above the main conveyor 13 just before the point where the main conveyor 13 starts to slope upwardly (that is the area 36 thereof).

The rear cutting means 15 in the embodiment illustrated in FIGS. 1 and 2 comprises rear cutters on both sides of the first conveyor 13. Each rear cutter comprises a driving drum 55, and a driven drum 56, with conventional chain cutters 57 extending between them. The drums 55, 56 are rotatable about horizontal axes 58, 59. The rear cutting means 15 is inoperative during in cutting (movement of the machine 10 in the direction of arrow 45), but is operative during movement in retreat (in the direction of arrow 46). This is accomplished by mounting by rear cutters 15 on movable frames 48 (see FIG. 2) which are guided for horizontal movement toward and away from the first conveyor 13 by guide channel 60. A "T" shaped portion 61 of the frame 48 slides within the channel 60 to guide the horizontal movement of the rear cutter 15. The mechanism for effecting movement of the rear cutters outwardly from the solid line position illustrated in FIG. 1 to the dotted line position 62 (in which position the cutters are operative) comprise the hydraulic cylinders 63. One cylinder 63 is connected via arm 64 to one frame 48, while the other cylinder 63 is connected via arm 65 to the other rear cutter frame 48. The cylinders 63 operate independently so theoretically (although not desirably) only one rear cutter 15 need be moved to an operative position during retreat.

It is also desirable to be able to move the rear cutters 15 upwardly so that they out cut approximately the same height for the bore as is cut by the top cob cutter 19. This is accomplished by utilizing hydraulic cylinders 67 (illustrated in both FIGS. 1 and 2) which are pivotally mounted at a first end 68 thereof to the frame 48, and at a second end 69 thereof to arm 70 interconnected to the drums 55, 56 (in basically the same manner illustrated for the cylinder in FIGS. 2 and 3 of U.S. Pat. No. 4,082,362). By extending the cylinder 67, the rear cutters 15 pivot upwardly about the axis 58 to the dotted line position 71 illustrated in FIG. 2.

Figure 4:
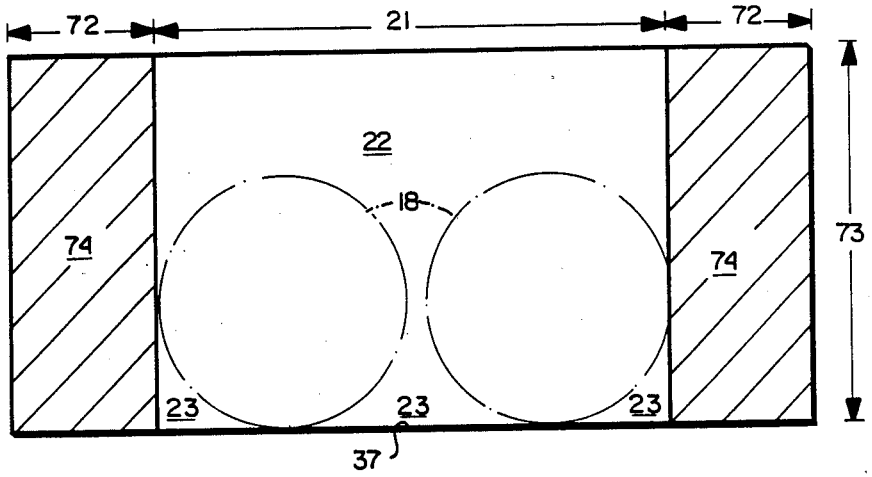
FIG. 4 is a schematic view showing exemplary bores formed in the practice of the present invention.

With reference to FIG. 4, during out cutting when the rear cutters 15 are moved to the outward dotted line position 62 and the upward dotted line position 71 illustrated in FIGS. 1 and 2, they cut the volume defined by the width 72 and height 73 illustrated in FIG. 4, on either side of the width of the bore 21 cut during in cutting. Thus, to initiate out cutting, the cutters 15 are gradually moved (during initial retreat movement of the machine 10) outwardly, as are shrouds 40 connected by links thereto, from a position completely within the width and other dimensions defined by the in cutting bore 21, to the shaded areas 74 (FIG. 4) outside of the volume of the in cutting bore.

It is desirable to power the entire mining machine 10 (that is the cutting and conveying action thereof) from structures mounted directly on the frame 11. For example the motor 30 mounted on frame 11 for powering the first conveyor 13 was described earlier. The rest of the components are preferably powered by the main motors 76 mounted on the frame between the front cutting means 12 and the second conveying means 14. For example the motors 76 are connected through planetary gear boxes 77 and thrust bearings 78 to power (through shafts 79) the front rotatable cutters 18. These same motors 76 are connected through other gear boxes and the like to power the cob cutters 19, 20, and are also connected via power train 80 or the like to the rear cutters to drive the driving drums 55. As earlier explained, through the reach gears or the like 52 the power for driving the spiral conveyors 41 of the second conveying means 14 is also provided by the motors 76. The motors 76 can also power the hydraulic motors necessary to extend or retract the cylinders 63, 67. It is desirable to clutch the motors 76 so that during in cutting they drive only the front cutting means 12, not the second conveying means 14 or the rear cutters 15; but during out cutting they drive the second conveying means 14 and the rear cutters 15 but do not drive the front cutters 12.

The power source for moving the mining machine 10 into the bore during in cutting, and retracting it from the bore during out cutting, is essentially conventional. The frame 11 typically will be mounted on four or more shoes 82 (see FIG. 2) which engage the bore floor 37 and have hydraulics for leveling the frame during mining. Operatively connected to the rear 16 of the frame may be conventional hydraulic rams which anchor themselves in the bore and then provide an inward push or outward pull. Alternatively, a cable and a winch arrangement can be used extending to the mouth of the bore, depending upon the connection of the cable and winch the frame either being thrust into the bore, or pulled out of the bore.

Figure 3:
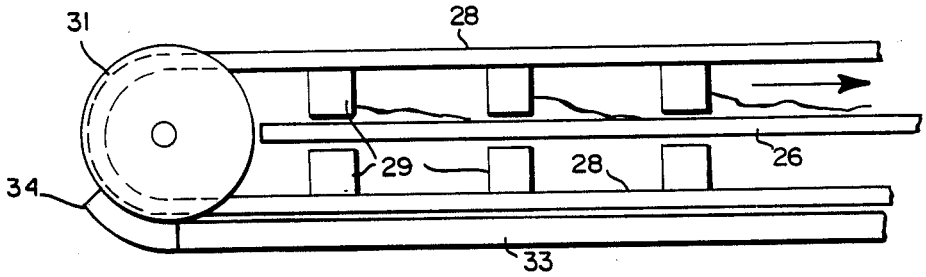
FIG. 3 is a detail schematic view showing the front portion of the first conveyor of the machine of FIGS. 1 and 2.
Figure 7:
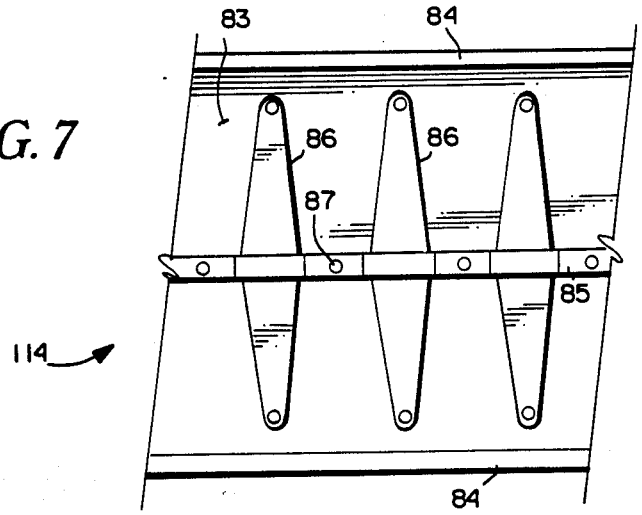
FIG. 7 is a detail schematic top view showing a portion of the second conveyor of the mining machine of FIGS. 1 and 2.
Figure 5:
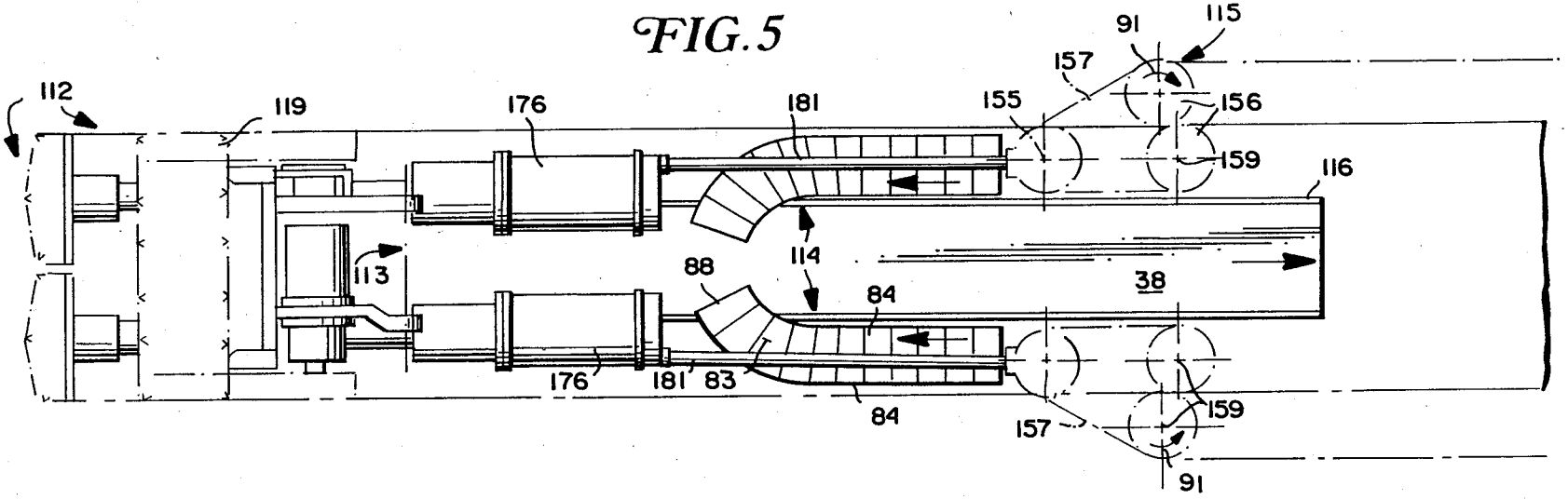
FIG. 5 is a top plan view of a second embodiment or a mining machine according to the invention.
Figure 6:
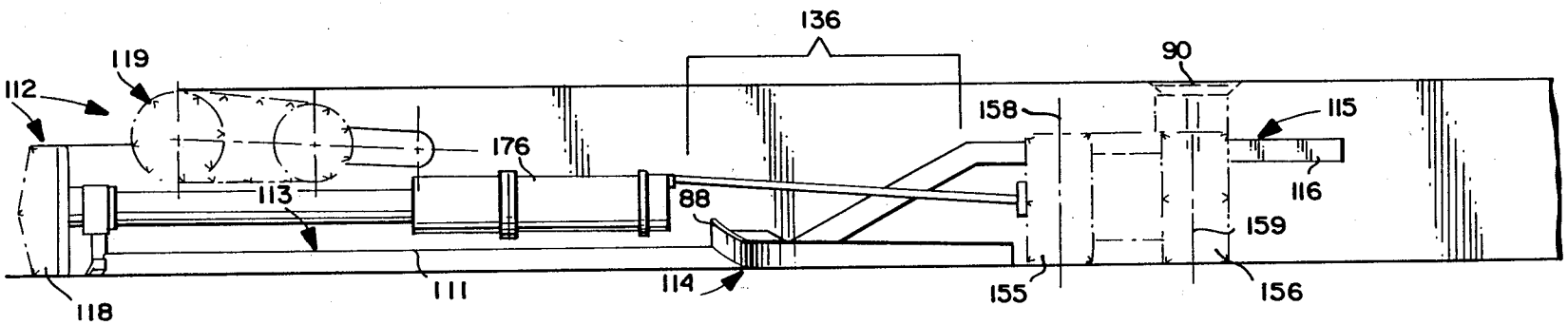
FIG. 6 is a side view of the mining machine of FIG. 5.

The embodiment illustrated in FIGS. 5 through 7 is similar to that illustrated in FIGS. 1 through 3, differing in only the details of the rear cutters and second conveyors. Structures functionally comparable to those in the FIGS. 1–3 embodiment are illustrated by the same reference numeral in the FIGS. 5 through 7 embodiment, only preceded by a "1". The details of the structures which are essentially identical (e.g. the front cutters 112, and the first conveyor 113) will not be described.

In the FIGS. 5 through 7 embodiment, the second conveying means 114 comprises a chain conveyor, only in this instance a universal chain conveyor. In this embodiment, the bottom plate 83 of a slide, having sidewalls 84, provides a structure over which the coal is conveyed. A central chain 85 (see FIG. 7) having flights 86 operatively connected thereto is powered over the plate 83. The flights 86 and chain 85 are pivotally interconnected at the areas 87 therebetween for pivotal movement about a vertical axis, which provides the "universal" aspect of this chain conveyor. The front end 88 of the slide is curved inwardly and is positioned above the first conveyor 113 to deposit cut coal onto the top of the first conveyor 113. The chain 85 is powered in a conventional manner by sprockets and a motor (not shown). The driving force for powering the sprockets may be suitable hook-ups to the motors 176.

In the embodiment of FIGS. 5 through 7, the rear cutters 115 comprise driving and driven drums 155, 156, respectively, these drums are rotatable about vertical axes 158, 159. The drums 156 are rotated in the direction of the arrows 91 in FIG. 5. They are moved from the inoperative retracted position illustrated in FIG. 5 to the outward operative position by hydraulic cylinders mounted to the frame 111 into a central arm structure (in essentially the same manner as illustrated in FIGS. 2 and 3 of U.S. Pat. No. 4,082,362). In order to cut the top of the bore in the same way that the upper cob cutter 119 does, it is preferable to provide a conventional pineapple cutter 90 associated with each driven drum 156.

OPERATION

The exemplary embodiments of the present invention having been described, an exemplary method of mining coal utilizing the same will now be described with particular reference to the embodiment of FIGS. 1 through 3.

The mining machine 10 is sumped inwardly into a bore of coal or the like, moving forwardly during in cutting in direction 45. During in cutting, the motors 76 power the front cutters 18, 19, 20 to cut coal. The cut coal is moved by the first, chain conveyor, 13 rearwardly with respect to the frame 11 until it ultimately is carried out of the area being mined by other conveyors. Ultimately a bore is formed having a width 21 and a height 73 as illustrated in FIG. 4. For example such a bore may have a dimension 21 of about seven feet, and a height 73 of about forty to sixty inches.

Once the desired depth of mining has been reached, the machine 10 is moved outwardly, in retreat. Out cutting is effected during retreat.

This is done by gradually moving the rear cutters 15 outwardly utilizing cylinders 63 so they move from a position in which they are within the dimensions of the bore defined by width 21, to a position where they are outside of the bore. By activating cylinders 67, the rear cutters 15 are also desirably pivoted upwardly so that they cut the full amount of the height 73. As the rear cutters 15 are moved outwardly, the shrouds 40 which are operatively connected thereto are also moved outwardly. The motors 76 are clutched so that front cutters 12 are no longer powered, but instead the spiral flights 50 are powered and the rear cutters 15 are powered. The motor 30 driving the first conveyor 13 continues to operate.

Out cutting in the direction 46 may be rapid since the coal cut by the rear cutters 15 is removed in essentially the same way that it would be removed during in cutting. The cut coal moves onto shrouds 40, and is "shoveled" by the shrouds 40 (during normal retreat movement of the machine 10) into operative engagement with the flights 50, which move the coal inwardly to the main conveyor 13, which then moves the coal rearwardly and out of the area being mined. Thus during retreat the cut coal is first moved in a forward direction 45 toward the front of the machine 10, then horizontally inwardly, and then rearwardly (direction 46). The flights 50 are powered separately so that no connecting structure interferes with the conveyance of the coal by the conveyor 13, and so that it is possible to operate only one of the rear cutters 15 during out cutting if desired. Out cutting can thus be essentially as fast as in cutting, and the volume 74 (see FIG. 4) of coal is removed during out cutting.

Because of the rapid out cutting, there is little chance of a cave-in in the bore until after the machine 10 has moved well past the areas where cave-in is likely to occur. Also since no operator need ever enter the bore, of course the mining operation is completely safe.

It will thus be seen that according to the present invention a mining machine and method have been provided which allow effective mining with substantially as fast out cutting as in cutting. While the invention has been herein shown and described in what is presently conceived to be the most practical and preferred embodiment, it will be obvious to those of ordinary skill in the art that many modifications may be made thereof within the scope of the invention, which scope is to be accorded the broadest interpretation of the appended claims so as to encompass all equivalent structures and methods.

What is claimed is:

1. A mining machine for mining an area, comprising:

a frame;

a front cutting means mounted adjacent the front of said frame;

a first conveying means for conveying cut material, from a front portion of the frame to the rear, and ultimately out of the area being mined;

a second conveying means mounted in back of said front cutting means, for conveying cut material from adjacent the rear portion of the frame toward the front, to be deposited on said first conveying means; and a rear cutting means located to the rear of said second conveying means for cutting material to be moved to said second conveying means as said machine is moving rearwardly.

2. A mining machine as recited in claim 1 further comprising motor drive means for driving said front cutting means and said rear cutting means, said motor drive means mounted on said frame in front of said rear cutting means.

3. A mining machine as recited in claim 2 wherein said motor drive means also comprises means for powering said second conveying means.

4. A mining machine as recited in claim 1 wherein said first conveying means comprises a chain conveyor having a substantially flat portion immediately adjacent and behind said front cutting means, and then angled to an elevated portion.

5. A mining machine as recited in claim 4 wherein said first conveying means chain conveyor is elevated to an elevated portion at approximately the position of said rear cutting means.

6. A mining machine as recited in claim 4 wherein said second conveying means comprises shroud means pivotally mounted for rotation about a vertical axis at a front portion thereof, and spiral conveyor means for conveying cut material from said shroud means horizontally to said first conveyor.

7. A mining machine as recited in claim 6 wherein said spiral conveying means is positioned adjacent said first conveying means at approximately the point where said first conveying means starts to slope upwardly.

8. A mining machine as recited in claim 4 wherein said second conveying means comprises a universal conveyor chain with an inwardly curved front-most portion.

9. A mining machine as recited in claim 8 wherein said inwardly curved front-most portion of said universal conveyor chain terminates just above said first conveying means just in front of the area where said first conveying means angles upwardly.

10. A mining machine as recited in claim 1 wherein said second conveying means comprises a universal conveyor chain with an inwardly curved front-most portion.

11. A mining machine as recited in claim 1 wherein said second conveying means comprises shroud means pivotally mounted about a vertical axis at a front end thereof, and spiral conveying means mounted adjacent the front end of said shroud means to receive cut material conveyed thereto by said shroud means and move it inwardly to a position above said first conveying means.

12. A mining machine as recited in claim 1 further comprising means for mounting said rear cutting means so that it is movable from a first, non-cutting position within the volume cut by said front cutting means, to a second, operative position in which it is outside at least a portion of the volume cut by said front cutting means.

13. A mining machine as recited in claim 12 wherein said rear cutting means comprise a pair of rear cutters, one on either side of said first conveying means, each rear cutter comprising driving and driven drums with chain cutters extending therebetween.

14. A mining machine as recited in claim 13 wherein said rear cutter drums are mounted for rotation about a horizontal axis, and further comprising means for pivoting at least one of said drums upwardly about another horizontal axis so that they move above the level of said first conveying means.

15. A mining machine as recited in claim 13 wherein said drums are mounted for cutting rotation about a vertical axis.

16. A mining machine as recited in claim 15 wherein at least one of said drums has a pineapple cutter extendable upwardly therefrom.

17. A mining machine for mining an area, comprising: a frame; a front cutting means mounted adjacent the front of said frame; a chain conveyor extending rearwardly from adjacent said front cutting means to convey cut material to the rear and ultimately out of the area being mined; shroud means pivotally mounted adjacent the front end thereof mounted on said frame along the length of said first conveying means; spiral conveying means mounted adjacent the front end of said shroud means and above said chain conveying means for conveying cut material from said shroud means to said chain conveying means; and rear cutting means mounted to the rear of said shroud means, and mounted for movement from a first, inoperative position within the volume defined by said front cutting means, to a second, operative position, outside at least a portion of the volume mined by said front cutting means.

18. A mining machine as recited in claim 17 wherein said rear cutting means comprise a pair of rear cutters, one mounted on either side of said chain conveyor, each pair comprising driven and driving drums rotatable about horizontal axes.

19. A mining machine for mining an area, comprising: a frame; a front cutting means mounted adjacent the front of said frame; a chain conveyor extending rearwardly from adjacent said front cutting means to convey cut material to the rear and ultimately out of the area being mined; a pair of universal conveyor chains, one mounted on either side of said conveying chain, and disposed within a channel having an inwardly arcuately shaped portion positioned to deposit cut material onto said chain conveyor; and rear cutting means located to the rear of said universal conveyor chains, and mounted for movement from a first, inoperative position within the volume defined by said front cutting means, to a second, operative position, outside at least a portion of the volume mined by said front cutting means.

20. A method of mining material in an area where no operator will be present, comprising the steps of:

(a) cutting into the area to be mined using a mining machine by moving the mining machine in a forward direction, to form a bore having given first dimensions;

(b) removing cut material as the mining machine is moved in the forward direction by moving the material rearwardly out of the area being mined;

(c) terminating forward movement into the area being mined, and then moving the mining machine rearwardly out of the bore while continuing to cut material so as to enlarge the bore from said first dimensions to second dimensions greater than said first dimensions; and (d) conveying the material cut during rearward movement first in a forward direction, and then ultimately rearwardly so that it moves out of the area being mined in the same manner that the material cut during forward movement is moved out of the area being mined.

* * * * *